US007341111B2

(12) United States Patent
Van et al.

(10) Patent No.: US 7,341,111 B2
(45) Date of Patent: Mar. 11, 2008

(54) EXPANDABLE BRIDGE PLUG AND SETTING ASSEMBLY

(75) Inventors: Tommy Wayne Van, The Woodlands, TX (US); Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 228 days.

(21) Appl. No.: 11/138,129

(22) Filed: May 26, 2005

(65) Prior Publication Data

US 2006/0266529 A1 Nov. 30, 2006

(51) Int. Cl.
*E21B 33/128* (2006.01)

(52) U.S. Cl. ..... 166/387; 166/123; 166/135; 166/182; 166/192

(58) Field of Classification Search ..... 166/387, 166/135, 192, 117, 181, 182, 143, 123
See application file for complete search history.

(56) References Cited

U.S. PATENT DOCUMENTS 1,945,943 A * 2/1934 Layne ..... 166/143
2,178,844 A * 11/1939 Baker ..... 166/142
2,715,943 A * 8/1955 True ..... 166/63
2,813,588 A * 11/1957 O'Reilly ..... 166/187
3,125,162 A * 3/1964 True ..... 166/123
3,160,209 A * 12/1964 Bonner ..... 166/63
4,436,150 A 3/1984 Barker
5,678,635 A 10/1997 Dunlap et al.
6,739,398 B1 * 5/2004 Yokley et al. ..... 166/382
6,814,143 B2 11/2004 Braddick

* cited by examiner

*Primary Examiner*—Kenneth Thompson
(74) *Attorney, Agent, or Firm*—Browning Bushman P.C.

(57) ABSTRACT

Bridge plug and setting assembly may be used in a well with a tubular therein to control flow through the tubular. A plurality of fluid powered units 16, 24 are suspended in a well from a work string 14 for exerting a driving force. A plug member 50 is suspended below the plurality of fluid powered units. The plug member 50 is axially movable relative to an expansion sleeve 40 in response to the driving force to radially expand the sleeve 40 into sealing engagement with both the plug member 50 and the tubular 12. A release mechanism 68 is provided for releasing the one or more fluid powered units from the plug member and the expansion sleeve once set in the well.

24 Claims, 2 Drawing Sheets

EXPANDABLE BRIDGE PLUG AND SETTING ASSEMBLY

FIELD OF THE INVENTION

The present invention relates to bridge plugs of the type used to control fluid flow in a well. More particularly, the invention relates to an expandable bridge plug assembly for sealing within an existing tubular in a well to provide high reliability against inadvertent fluid flow past the bridge plug.

BACKGROUND OF INVENTION

Bridge plugs have long been used in the oil and gas industry to control the flow of fluid through the well. A bridge plug commonly may employ resilient elastomeric sealing rings and anchoring slips, and may either seal off all flow through the well to isolate a lower interval from an upper interval in a well, or may be supplied with an internal passage or a choke to reduce or control flow through tubular at a desired depth.

A compression set bridge plug adaptable for through tubing operations is disclosed in U.S. Pat. No. 5,678,635. The anchor mechanism includes upper and lower independently movable slips. U.S. Pat. No. 4,436,150 discloses a bridge plug with an internal bypass passage which is closed when the bridge plug is set. The bridge plug includes external slips on a slip carrier. Bridge plugs are commonly hydraulicly or mechanically set. While various procedures have been employed for setting the bridge plug, sealing reliability between the bridge plug and the wall of the tubular in the well has been a significant problem, particularly when intended to seal off high pressure gas below the bridge plug.

The problems with the existing bridge plugs include poor reliability, particularly to seal gas in a well after the bridge plug has been set. In a subsea well, for example, tubular may be cut at or below the mud line and a bridge plug placed in the well to completely seal off the well. If gas bypasses the bridge plug, it bubbles to the surface and creates environmental hazzards. Accordingly, expensive remedial action must be taken to set another bridge plug in the well to stop the inadvertent flow of gas from the well.

The disadvantages of the prior art are overcome by the present invention, and an improved bridge plug assembly and method of setting a bridge plug in a well are hereinafter disclosed.

SUMMARY OF THE INVENTION

In one embodiment, a bridge plug and setting assembly are used to seal off fluid flow through a tubular in a well. One or more fluid powered units are provided for suspending in the well on a work string to exert a driving force, and a plug member having a closed end is suspended in the well below the one or more fluid powered units. An expansion sleeve is axially movable relative to the plug member in response to the driving force to radially expand the sleeve into sealing engagement with both the plug member and the tubular. A release mechanism is provided for releasing the one or more fluid powered units from the plug member and the expansion sleeve once set in the well. A flow passageway may be provided from the interior of the plug member to an annulus surrounding the power units. A bearing between the work string and the plug member facilitates rotation of the work string relative to the plug member. A ball seat at the lower end of the work string receives a ball to increase fluid pressure to the fluid power units, and releases the ball upon an increase in fluid pressure to drain the work string once a plug member and expansion sleeve are set in the well.

An advantage of the system and method of the present invention for setting a plug member in a well is the use of conventional components with high reliability. Existing personnel with a minimum of training may reliably use the system according to the invention.

These and further features and advantages of the present invention will become apparent from the following detailed description, wherein reference is made to the figures in the accompanying drawings.

DETAILED DESCRIPTION OF PREFERRED EMBODIMENTS

Figure 1A:
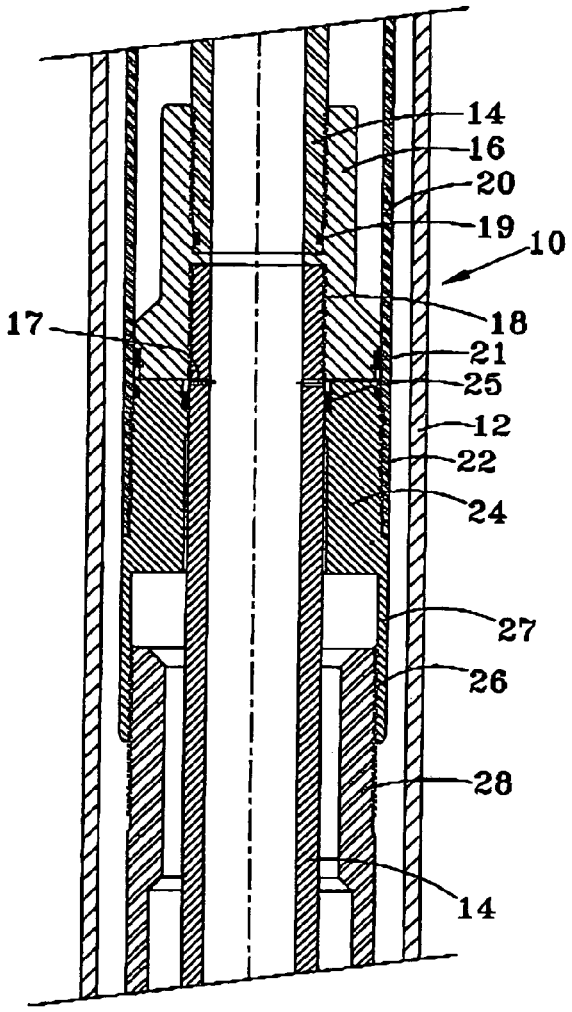
FIG. 1A is a cross-sectional view of an upper portion of the plug member setting assembly, illustrating a pair of pistons in the run-in position.
Figure 1B:
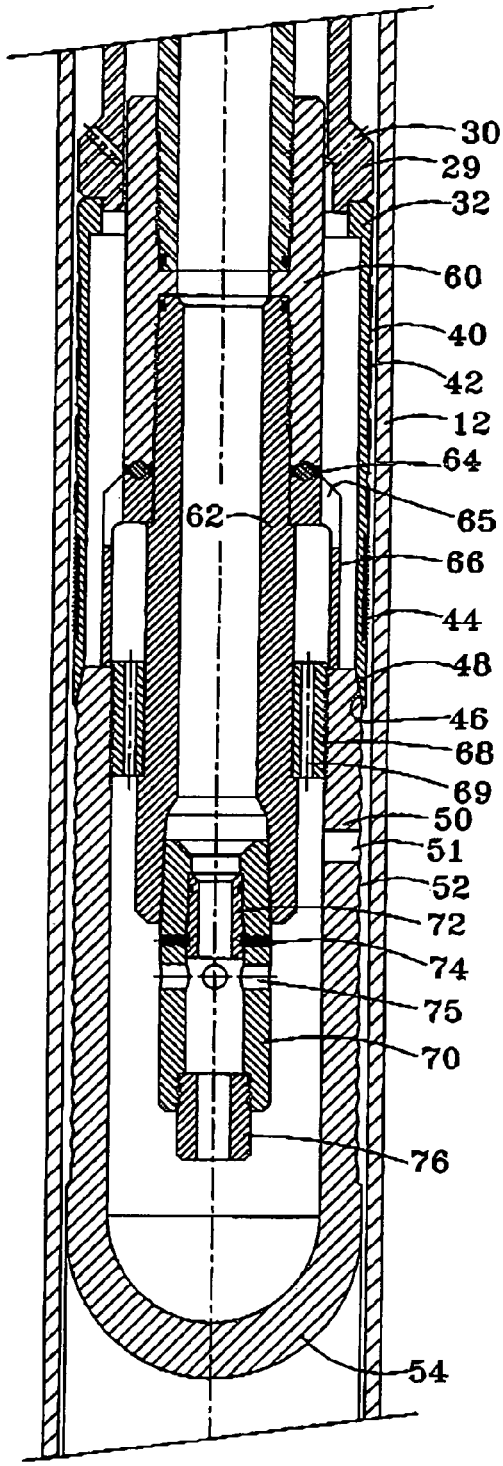
FIG. 1B is a cross-sectional view of the assembly, illustrating the setting sleeve above the plug member.

FIGS. 1A and 1B depict upper and lower portions, respectively, of a suitable setting tool assembly and an expandable bridge plug for use in a well with a tubular 12 therein. The bridge plug assembly may be used to control flow of fluid through the tubular. The plug member and expansion sleeve are provided below a plurality of fluid powered units suspended in the well from a work string 14 for exerting a driving force. The powered units comprise an upper connector or piston 16 threaded to the work string 14 by threads 18, with the upper connector or piston 16 having a conventional static seal 19 between the work string 14 and the upper connector 16, and a dynamic seal 21 between connector 16 and the ID of the outer sleeve 20. The fluid powered units also include a lower connector or piston 24, which is threaded at 22 and sealed to the outer sleeve 20 by a similar static seal, and includes a dynamic seal 25 for sealing with the OD of the mandrel or work string 14. As shown in FIG. 1A, a lower sleeve shaped extension 27 from connector 24 is threaded at 26 to actuator sleeve 28. A plurality of flow ports 17 pass through the inner mandrel 14 for exerting an upward fluid pressure force on the upper connector 16 and similarly a downward force on the lower connector 24.

A lower end 29 of the actuator sleeve 28 abuts the top of the expansion sleeve 40, and more particularly the upper head portion 32 of the expansion sleeve, as shown in FIG. 1B. Threaded connector 60 structurally interconnects the lower portion of the inner mandrel 14 with the tubular member 62. An inverted cup-shaped member 66 is positioned between the lower end of the connector 60 and the top of plug member 50, with bearing 64 facilitating rotation of the mandrel 14 and the connector 60 relative to the inverted cup member 66 and the plug member 50.

Expansion sleeve 40 includes a plurality of annular radially outer sealing members 42, and circumferentially spaced outer slips 44. The sealing members 42 provide a fluid tight seal with the interior of the tubular 12, and the slips 44 axially fix the expanded sleeve to the tubular.

When run in the well, its lower tapered end 46 of the expansion sleeve may thus be in engagement with the upper tapered surface 48 of the plug member 50, which includes a plurality of annular bumps 52 for reliable sealing engagement with the interior of the expansion sleeve once the plug member is set in the well. Plug member 50 may have various configurations, but in a preferred embodiment has a generally U-shaped construction, with a lower closed end 54 as shown.

The annular bumps could alternatively be provided on the ID of the expansion sleeve rather than on the OD of the plug member 50, although providing the bumps on the expansion sleeve may be less costly to manufacture.

Although not shown in FIG. 1A, those skilled in the art should appreciate that the setting assembly will normally include a series of axially movable upper connectors or pistons 16 and a series of axially movable lower connectors or pistons 24, so that the upper connectors 16 act in series to pull up on the mandrel 14 relative to the axially stationary sleeve 40, and the lower pistons or connectors 24 push downward on the outer sleeve 20 and thus the actuating sleeve 28. The series of inner and outer pistons or connectors exert a substantial axial force on both the expansion sleeve and the plug member in excess of 100,000 lbs, and preferably in excess of 150,000 lbs, to reliably expand the sleeve and secure the plug member in the well.

Figure 2:
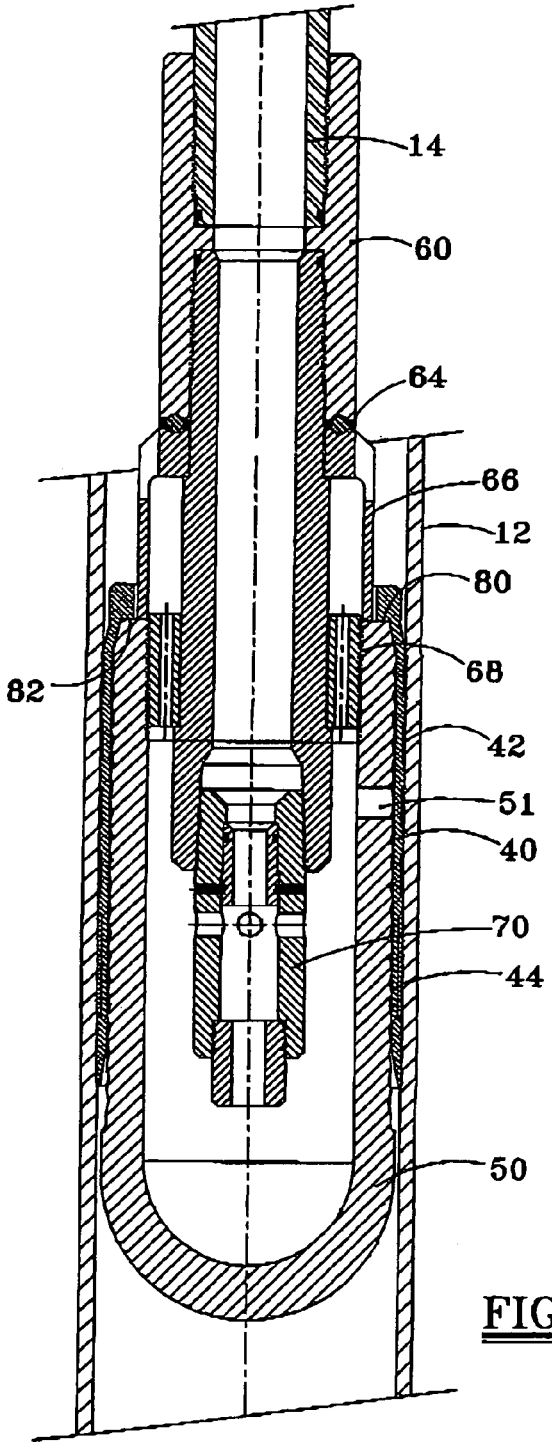
FIG. 2 is a cross-sectional view of the bridge plug and setting sleeve set within a tubular.

FIG. 1B discloses a ball seat 72 positioned within sleeve 70 threaded to the lower end of sleeve 62. A ball may thus be dropped to land on the seat 72 to increase fluid pressure in the interior of the mandrel 14, which activates the setting assembly. Once the plug member is set, shear pins or other shear member 74 may separate, allowing the ball seat to drop downward to stop 76. The passageway through the stop 76 as well as ports 75 ensure fluid communication between the interior of the plug member and the annulus surrounding the fluid power units. Nut member 68 includes circumferentially spaced flow passageways 69, cup member 66 includes circumferentially spaced flow passageways 65, and the lower end 29 of actuating sleeve 28 includes circumferentially spaced flow passageways 30, thereby providing fluid communication between the annulus surrounding the setting assembly and the interior of the plug member. One or more ports 51 in the plug member 50 allow fluid communication between the interior of the plug member and the interior of the tubular 12 below the plug member, as shown in FIG. 2B. Once the plug member has moved within the expansion sleeve 46 as shown in FIG. 2, the ports 51 are closed off by seals on the expansion sleeve above and below ports 51. This feature allows a relatively dry work string to be pulled from the well once the plug member and expansion sleeve are set in the well.

During the operation of setting the plug member, fluid pressure is increased within the work string and is thus supplied to the fluid powered units, connectors or pistons 16, 24 to exert a driving force by pushing upwards on the pistons 16 and downward on the pistons 24. Referring to FIG. 2, this operation effectively pulls the plug member 50 upward within the setting sleeve 40, thereby pushing the setting sleeve radially outward until the annular seals 42 are in sealing engagement with the interior of the casing 12, and the circumferentially spaced slips 44 grip the tubular 12. This movement of the plug member 50 relative to the setting sleeve 40 is limited when the upper end 80 of the plug member 50 engages a stop surface 82 at the upper end of the sleeve 40. During this expansion operation, trapping of fluid pressure is prevented by the passageway 75, 69, 65, and 30 which allow fluid communication between the interior of the work string 12, the interior of plug 50, and the annulus surrounding the fluid powered units.

Figure 3:
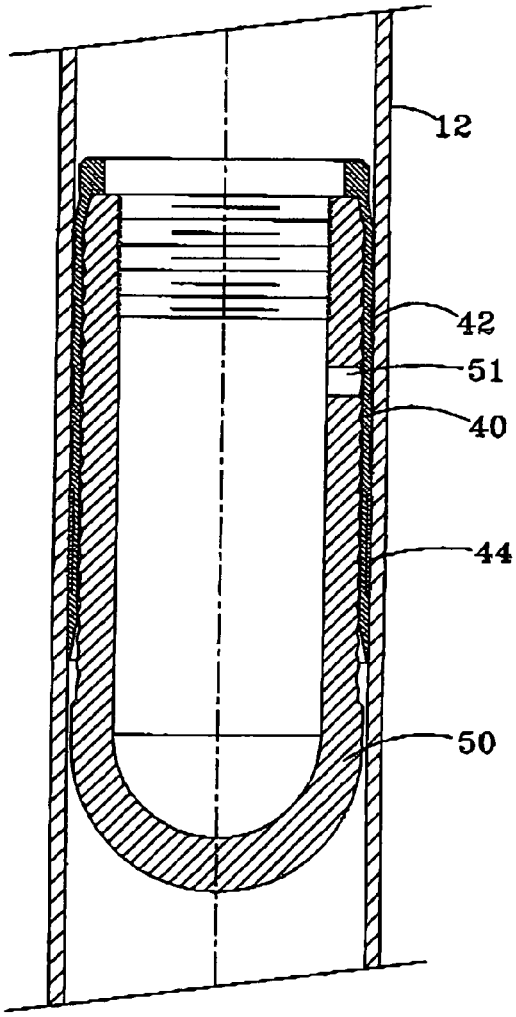
FIG. 3 is a cross-sectional view of the bridge plug and the setting sleeve set in a tubular, with the setting assembly retrieved to the surface.

Once the plug member 50 is set in the well, fluid pressure may be increased to release the ball, as previously described. The work string 14 may then be rotated to the right, with the bearing 64 allowing the inverted cup shaped member 66 to remain stationary with the set plug member 50 while rotating the work string 14. Nut 68 is unthreaded by this right hand operation from the mandrel or work string, thereby detaching the work string and setting assembly from the set plug member and setting sleeve. With the nut 68 unthreaded from the plug member 50, the remaining apparatus may be retrieved to the surface, leaving the plug member 50 and the setting sleeve 40 reliably set in the well, as shown in FIG. 3.

Various types of plug members may be used for control of fluid flow through a tubular. The plug member may completely block fluid flow once set in a well, or may include a restrictive aperture to allow controlled axial fluid flow through the set plug member, or may have a small diameter tubular passing axially through the bridge plug. The plug member need not be U-shaped, but may alternatively be a substantially solid and generally cylindrical shaped plug member.

In addition to left hand threads, various types of release mechanisms may be used for releasing the fluid powered units from the plug member and expansion sleeve once set in the well, including an axially movable collet mechanism. Other conventional release mechanisms include a releasable collet mechanism, a keeper which may engage and disengage a groove, or a releasable catch mechanism.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A bridge plug and setting assembly for use in a well with a tubular therein to control flow through the tubular, comprising:

a plurality of fluid powered units suspended in the well on a work string for exerting a driving force;

a plug member for suspending in the well below the plurality of fluid powered units;

the plug member axially movable relative to an expansion sleeve in response to the driving force to radially expand the sleeve into sealing engagement with both the plug member and the tubular;

a first of the plurality of fluid powered units exerts the driving force on the plug member, and a second of the plurality of fluid powered units exerts the driving force on the expansion sleeve; and a release mechanism for releasing the plurality of fluid powered units from the plug member and the expansion sleeve once set in the well.

2. A bridge plug and setting assembly as defined in claim 1, when the plug member has a generally U-shaped configuration.

3. A bridge plug and setting assembly and setting assembly as defined in claim 1, further comprising:

flow passageways from an interior of the plug member to an annulus surrounding the plurality of power units.

4. A bridge plug and setting assembly as defined in claim 1, wherein the plug member has a generally cylindrical exterior surface with a plurality of annular bumps thereon for sealing with the expansion sleeve.

5. A bridge plug and setting assembly is defined in claim 1, further comprising:

the expansion sleeve including one or more annular seals for sealing engagement with the tubular and one or more slips fixed to the sleeve for fixed engagement with the tubular.

6. A bridge plug and setting assembly as defined in claim 1, wherein the plurality of powered units included a plurality of fluid powered pistons arranged in series to create the driving force in response to fluid pressure within the work string.

7. A bridge plug and setting assembly as defined in claim 6, further comprising:

a ball seat at a lower end of the work string and positioned within the plug member, the ball seat adapted for receiving a ball to increase fluid pressure to the plurality of fluid powered units, and for the releasing the ball upon an increase in fluid pressure to drain the work string once the plug member and expansion sleeve are set in the well.

8. A bridge plug and setting assembly as defined in claim 1, further comprising:

a bearing between the work string and the plug member to facilitate relative rotation between the work string and the plug member.

9. A bridge plug and setting assembly is defined in claim 1, wherein right hand release of the work string releases the plurality of fluid powered units from the plug member once the plug member and the expansion sleeve are set in the well.

10. A bridge plug and setting assembly for use in a well with a tubular therein to control flow through the tubular, comprising:

a plurality of fluid powered units suspended in the well on a work string for exerting a driving force, the plurality of powered units including a plurality of pistons arranged in series to create the driving force;

a plug member having a generally U-shaped configuration for suspending in the well below the plurality of fluid powered units;

the plug member axially movable relative to an expansion sleeve in response to the driving force to radially expand the sleeve into sealing engagement with both the plug member and the tubular, the expansion sleeve including one or more annular seals for sealing engagement with the tubular and one or more slips fixed to the sleeve for fixed engagement with the tubular;

a release mechanism for releasing the plurality of fluid powered units from the plug member and the expansion sleeve once set in the well; and right hand rotation of the work string releases the one or more fluid powered units from the plug member once the plug member and the expansion sleeve are set in the well.

11. A bridge plug and setting assembly and setting assembly as defined in claim 10, further comprising:

flow passageways from an interior of the plug member to an annulus surrounding the power units.

12. A bridge plug and setting assembly as defined in claim 10, wherein the plug member has a generally cylindrical exterior surface with a plurality of annular bumps thereon for sealing with the expansion sleeve.

13. A bridge plug and setting assembly as defined in claim 10, further comprising:

a bearing between the work string and the plug member to facilitate relative rotation between the work string and the plug member.

14. A bridge plug and setting assembly as defined in claim 10, further comprising:

a ball seat at a lower end of the work string and positioned within the plug member, the ball seat adapted for receiving a ball to increase fluid pressure to the one or more fluid powered units, and for the releasing the ball upon an increase in fluid pressure to drain the work string once the plug member and expansion sleeve are set in the well.

15. A method of setting a bridge plug in a well with a tubular therein to control flow through the tubular, comprising:

suspending a plurality of fluid powered units in the well on a work string for exerting a driving force;

suspending a plug member having a closed end for in the well below the plurality of fluid powered units, the plug member having a generally cylindrical exterior surface with a plurality of annular bumps thereon for sealing with the expansion sleeve;

axially moving the plug member relative to the expansion sleeve in response to the driving force to radially expand the sleeve into sealing engagement with both the plug member and the tubular, the expansion sleeve including one or more annular seals for sealing engagement with the tubular and one or more slips fixed to the sleeve for fixed engagement with the tubular; and releasing the plurality of fluid powered units from the plug member and the expansion sleeve once set in the well.

16. A method as defined in claim 15, further comprising:

providing flow passageways from an interior of the plug member to an annulus surrounding the power units.

17. A method in claim 15, further comprising:

providing a ball seat at a lower end of the work string and positioned within the plug member, the ball seat adapted for receiving a ball to increase fluid pressure to the plurality of fluid powered units; and releasing the ball upon an increase in fluid pressure to drain the work string once the plug member and expansion sleeve are set in the well.

18. A bridge plug and setting assembly for use in a well with a tubular therein to control flow through the tubular, comprising:

a plurality of fluid powered units suspended in the well on a work string for exerting a driving force;

a plug member for suspending in the well below the plurality of fluid powered units;

the plug member axially movable relative to a metal expansion sleeve in response to the driving force to radially expand the metal sleeve into sealing engagement with the tubular, the metal expansion sleeve including one or more annular seals for sealing engagement with the tubular and one or more slips fixed to the sleeve for fixed engagement with the tubular; and a release mechanism for releasing the one or more fluid powered units from the plug member and the metal expansion sleeve once set in the well, such that the plug member and well expansion sleeve remain downhole when the plurality of fluid powered units are returned to the surface.

19. A bridge plug and setting assembly as defined in claim 18, further comprising:

a ball seat at a lower end of the work string and positioned within the plug member, the ball seat adapted for receiving a ball to increase fluid pressure to the plurality of fluid powered units, and for the releasing the ball upon an increase in fluid pressure to drain the work string once the plug member and expansion sleeve are set in the well.

20. A bridge plug and setting assembly as defined in claim 18, further comprising:

a bearing between the work string and the plug member to facilitate relative rotation between the work string and the plug member.

21. A bridge plug and setting assembly is defined in claim 18, wherein right hand release of the work string releases the plurality of fluid powered units from the plug member once the plug member and the expansion sleeve are set in the well.

22. A bridge plug and setting assembly for use in a well with a tubular therein to control flow through the tubular, comprising:

a plurality of fluid powered units suspended in the well on a work string for exerting a driving force;

a plug member for suspending in the well below the plurality of fluid powered units;

the plug member axially movable relative to a metal expansion sleeve in response to the driving force to radially expand the metal sleeve into sealing engagement with the tubular;

a release mechanism for releasing the one or more fluid powered units from the plug member and the metal expansion sleeve once set in the well, such that the plug member and well expansion sleeve remain downhole when the plurality of fluid powered units are returned to the surface; and a ball seat at a lower end of the work string and positioned within the plug member, the ball seat adapted for receiving a ball to increase fluid pressure to the plurality of fluid powered units, and for the releasing the ball upon an increase in fluid pressure to drain the work string once the plug member and expansion sleeve are set in the well.

23. A bridge plug and setting assembly as defined in claim 22, further comprising:

a bearing between the work string and the plug member to facilitate relative rotation between the work string and the plug member.

24. A bridge plug and setting assembly is defined in claim 22, wherein right hand release of the work string releases the plurality of fluid powered units from the plug member once the plug member and the expansion sleeve are set in the well.

* * * * *